US005649773A

United States Patent [19]

Sarbin

[11] Patent Number: 5,649,773

[45] Date of Patent: Jul. 22, 1997

[54] SHUTTLE MATRIX LINE PRINTER WITH PRINT HEAD SERVICE DIAGNOSTIC AND METHOD

[75] Inventor: Richard H. Sarbin, Waynesboro, Va.

[73] Assignee: Genicom Corporation, Waynesboro, Va.

[21] Appl. No.: 582,519

[22] Filed: Jan. 3, 1996

[51] Int. Cl.[6] ..... B41J 2/30

[52] U.S. Cl. ..... 400/124.07; 400/53

[58] Field of Search ..... 400/53, 54, 124.07, 400/124.13

[56] References Cited

U.S. PATENT DOCUMENTS

| | | | |
|---|---|---|---|
| 4,204,777 | 5/1980 | Jen . | |
| 4,566,813 | 1/1986 | Kobayashi et al. . | |
| 4,576,490 | 3/1986 | Isobe | 400/149 |
| 4,653,940 | 3/1987 | Katsukawa . | |
| 4,984,913 | 1/1991 | Silverman et al. . | |
| 5,064,302 | 11/1991 | Tanuma et al. . | |
| 5,074,684 | 12/1991 | Yoshida et al. | 400/124.07 |
| 5,092,695 | 3/1992 | Silverman et al. . | |
| 5,137,377 | 8/1992 | Ito et al. . | |
| 5,152,619 | 10/1992 | Niikawa et al. | 400/54 |
| 5,188,465 | 2/1993 | Johnson et al. . | |
| 5,382,101 | 1/1995 | Iguchi . | |

*Primary Examiner*—John S. Hilten
*Attorney, Agent, or Firm*—Nixon & Vanderhye P.C.

[57] ABSTRACT

A dot matrix line printer includes a counter that counts a number of print actions performed by each of a plurality of print actuators. The accumulated number of print actions can be compared to a reference number of print actions representative of a useful print actuator life for each print actuator. The counting process is performed based on the horizontal dot density, the number of print actuators, the number of bytes of dot data that each of the actuators is required to process, etc. This structure and method enable maximized use of print actuators regardless of location along the actuator array.

32 Claims, 5 Drawing Sheets

PRINT ACTUATOR USAGE

SHUTTLE MATRIX LINE PRINTER WITH PRINT HEAD SERVICE DIAGNOSTIC AND METHOD

BACKGROUND OF THE INVENTION

The present invention relates to a dot matrix printer and, more particularly, to a dot matrix line printer including a print head service diagnostic and method for maximizing print actuator life.

In a shuttle matrix line printer, a single horizontal array of print wires is evenly spaced across the whole print line width. To illustrate the present invention, two exemplary printer model configurations will be described. The first model configuration is an 800 line per minute version using 33 print head modules containing two actuators each for a total of 66 actuators. In this configuration, each actuator will oscillate over 0.2 inches of dot data. The second model is a 400 line per minute version that contains 33 print head modules holding single actuators for a total of 33 actuators. In this configuration, each actuator oscillates over 0.4 inches of dot data. On each half cycle of the shuttle oscillation, the print modules will print a single horizontal dot line.

In general, a typical print actuator has a useful life of approximately one billion dots, depending on use and other factors. Because certain print actuators inherently generate more dot data by virtue of their position along the line width, it is difficult to determine when a particular print actuator is nearing the end of its useful life. Moreover, because all actuators are used over varying frequencies, it is difficult to determine which actuator should be replaced and which actuators should be left in position.

There is therefore a need to provide a dot matrix printer that is capable of monitoring the number of print actions performed by each of the print actuators to maximize output of the print actuators over their useful life regardless of their position along the actuator array.

SUMMARY OF THE INVENTION

It is therefore an object of the invention to provide a dot matrix line printer and method including a print head service diagnostic that maintains a count of the number of print actions performed by each of the print actuators.

This and other objects of the invention are achieved by providing a dot matrix printer including a plurality of print actuators and a controller that controls operations of the plurality of print actuators. The controller is provided with a counter for counting a number of print actions performed by each of the plurality of print actuators and a memory for storing the number of print actions. The number of print actions stored in the memory is compared to a reference number of print actions representative of a useful print actuator life.

The printer may further include a plurality of print head modules, preferably but not necessarily 33, each including at least one of the plurality of print actuators. The memory may include a volatile memory that temporarily stores the number of print actions for each print actuator and a non-volatile memory that stores accumulated data of the number of print actions for each print actuator. In this regard, the controller transfers data stored in the volatile memory to the non-volatile memory after all printable dot data have been processed.

In accordance with another aspect of the invention, there is provided a method of operating a dot matrix printer. The method includes counting a number of print actions performed by each of the plurality of print actuators and storing the number of print actions. The number of print actions is then compared to a reference number of print actions representative of a useful print actuator life.

The method may further include, prior to counting, initializing the printer, which includes determining a number of bytes of dot data that each of the plurality of print actuators will be required to process. In addition, the method may include verifying a horizontal density of the dot data, wherein if the horizontal density is different than a set horizontal density, a number of bytes of dot data that each of the plurality of print actuators will be required to process is redetermined.

The counting step preferably includes counting the print actions after each row of print data is processed and updating the number of print actions stored in the memory. Each row of print data is preferably stored in an image buffer, and each row of print data stored in the image buffer is scanned to determine a number of dots printed. The updating step may include updating the number of print actions stored in the memory one print actuator at a time.

The storing step may include temporarily storing the number of print actions in a volatile memory, and transferring the number of print actions stored in the volatile memory to a non-volatile memory when all print data has been processed. The number of print actions for a spent one of the print actuators is reset when the spent print actuator is replaced. A chart can be output that is representative of the number of print actions performed by each of the plurality of print actuators.

In accordance with still another aspect of the invention, there is provided a dot matrix printer including a plurality of print actuators. The dot matrix printer includes a counter for counting a number of print actions performed by each of the plurality of print actuators and a storage device for storing the number of print actions.

The counter may include structure for counting the print actions after each row of print data is processed, and structure for updating the number of print actions stored in the storage device. The printer may also be provided with an image buffer storing each row of print data, wherein the counter also includes a scanner for scanning each row of print data stored in the image buffer to determine the number of dots printed. Still further, the updating structure may update the number of print actions stored in the storage device one print actuator at a time. The storage device preferably includes a volatile memory temporarily storing the number of print actions, a non-volatile memory, and structure for transferring the number of print actions from the volatile memory to the non-volatile memory when all print data has been processed.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
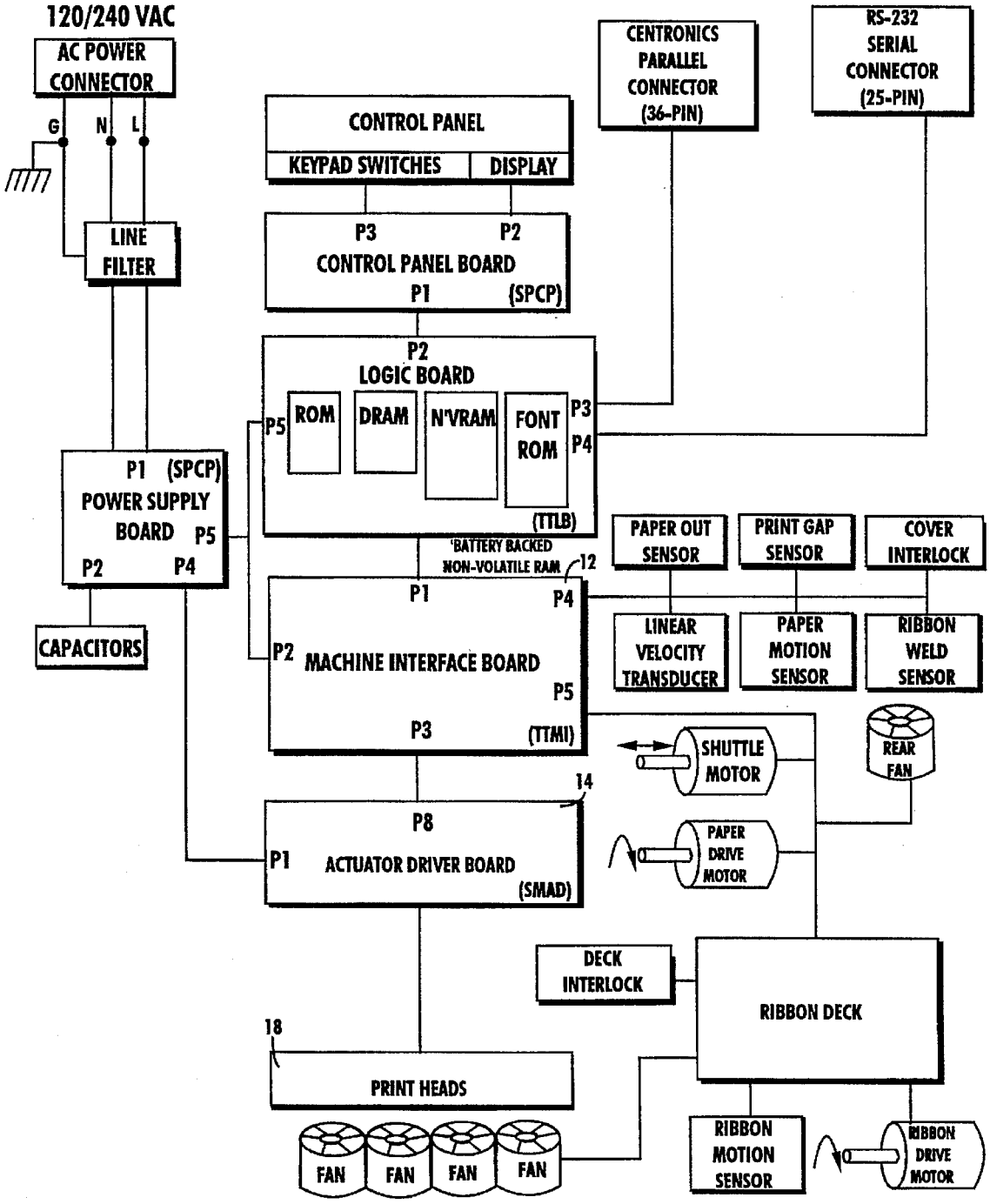
FIG. 1 is a block diagram illustrating the fundamental mechanical and electrical structure of the dot matrix line printer.

FIG. 1 illustrates basic mechanical and electrical structure of the dot matrix line printer. Since the components of this structure are generally known, a detailed description is not provided. The controller of the dot matrix printer includes a logic board 10, a machine interface board 12, and an actuator driver board 14. The controller controls operation of a plurality of print head modules 18, each print head module including for example one or two print actuators.

The logic board 10 includes the main CPU and a storage medium including a volatile memory (e.g., DRAM), a non-volatile memory (e.g., NVRAM), and a read only memory ROM. The DRAM includes input buffers, print buffers, imaging memory, and other temporary storage. The NVRAM stores dot count data and is powered through a battery back-up so that the actuator dot count data is maintained even when power is turned off to the dot matrix printer. The ROM stores an algorithm for the operations of the controller (described below). A FONT ROM is also included with the storage medium and contains dot matrix pattern data.

Figure 3:
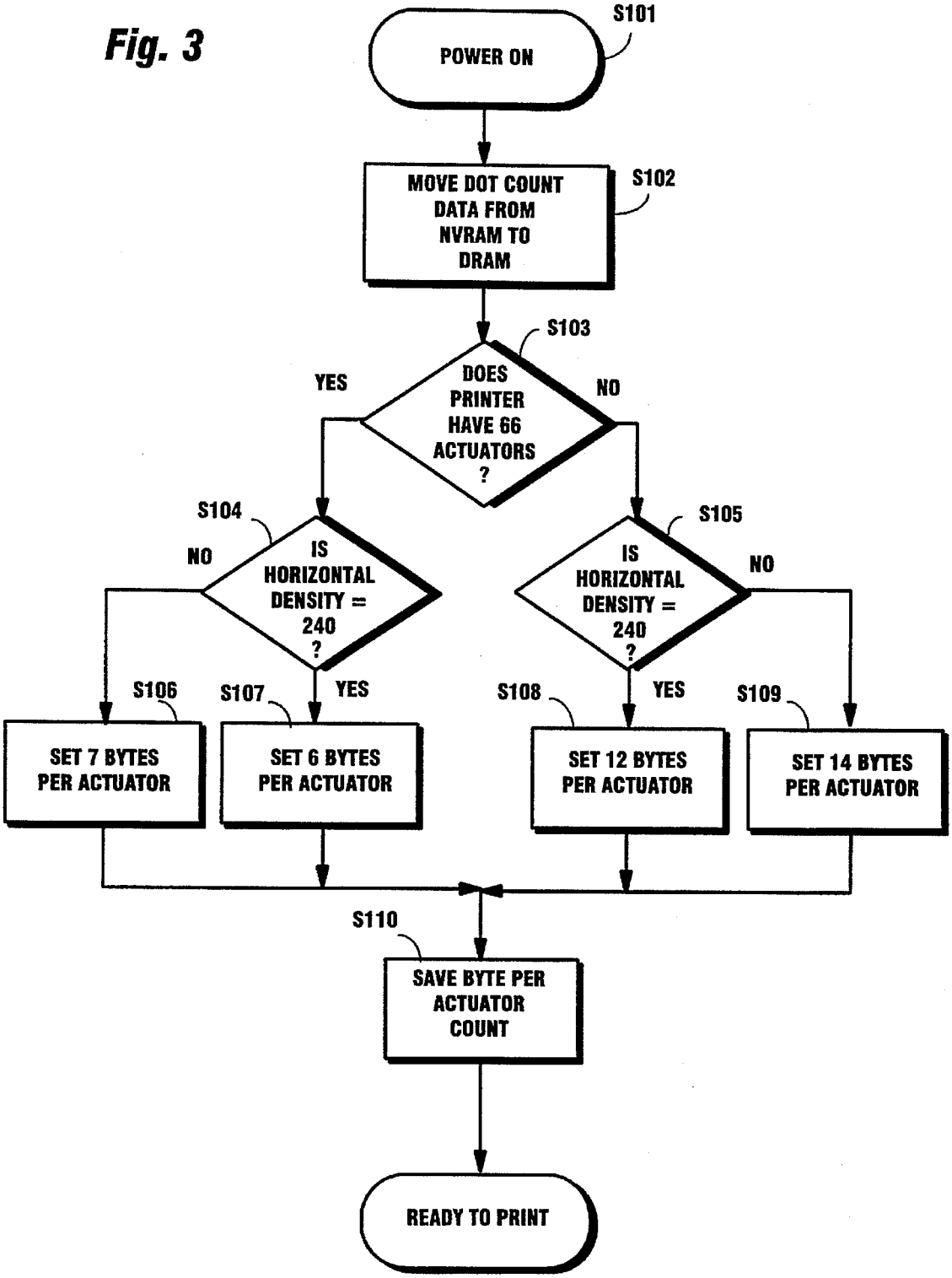
FIG. 3 is a flowchart showing the initialization process for actuator dot counting.

The machine interface board 12 controls shuttle motion, provides timing for coordination of print action with the shuttle motion, controls print wire action, controls paper movement, and senses and reports various status conditions of the printer. The machine interface board 12 receives dot data and control signals from the logic board 10 and passes the dot data to the actuator driver board 14 for printing. The actuator driver board 14 receives the dot image data from the Machine Interface Board 12 in serial format, converts it to parallel form, and drives the appropriate print wire actuators The operations carried out by the controller according to the invention will be described with reference to FIGS. 3–5. FIG. 3 is a flowchart showing the dot matrix printer initialization process. When power is applied to the printer in step S101, the currently stored dot count data (if any) is transferred from the non-volatile RAM to the printer's fast access DRAM for temporary storage (step S102). During printer initialization, a calculation is performed to determine the number of bytes of dot data that each print actuator will be required to process.

The byte per actuator calculation is based on the horizontal dot density and the number of print actuators contained within the printer. A printer with 66 actuators and a horizontal dot density of 240 dots per inch, for example, requires each actuator to process six bytes of data. If the horizontal dot density is 280 dots per inch, for example, each actuator processes seven bytes of data. With the 33 actuator model, at a horizontal dot density of 240 dots per inch, each actuator processes 12 bytes of data, and with a horizontal dot density of 280 dots per inch, each actuator processes 14 bytes of data.

In step S103, the controller determines whether the printer has 66 actuators (yes in step S103) or 33 actuators (no in step S103). The controller then respectively determines whether the horizontal dot density is 240 dots per inch or 280 dots per inch in steps S104 and S105. The corresponding number of bytes of dot data for the print actuators is set in steps S106 through S109. This value is stored in step S110.

Figure 4:
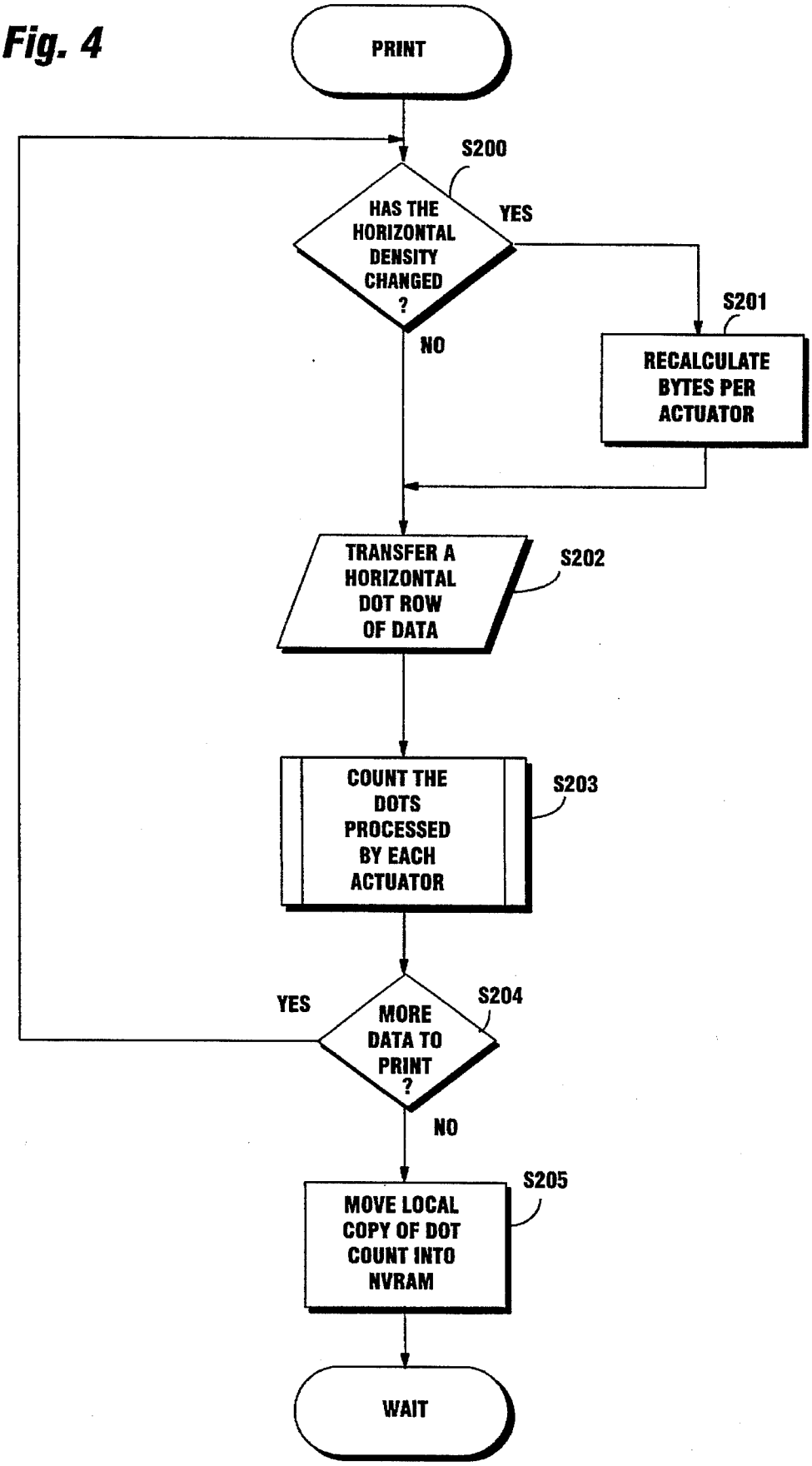
FIG. 4 is a flowchart showing the printing process.

After the initialization process is completed, the printer is ready to process print data. FIG. 4 is a flowchart illustrating the print process carried out by the controller. Since the printer has the capability of printing multiple horizontal print densities, a check is performed in step S200 to verify that the new print data is the same as the current horizontal density. If the horizontal density has changed by, for example, print codes in the dot data (yes in step S200), a calculation is performed to determine the number of bytes of dot data that each actuator will process at the new horizontal density (step S201). After this recalculation or if the horizontal dot densities are the same, the dot data is then transferred to the imaging hardware for printing in step S202, which conventionally includes storing the dot data in an image buffer. After each print line of dot data is processed, the controller performs the counting operation according to one example embodiment of the invention to count the number of dots "fired" (described below). After the counting operation, it is determined in step S204 whether there is more data for printing. If so (i.e., "yes" in step S204), the controller returns to step S200 to again check the horizontal density and begin processing another row of data. When all of the printable data has been processed (i.e., "no" in step S204), the dot count data are transferred from the DRAM to the non-volatile memory NVRAM (step S205).

Figure 5:
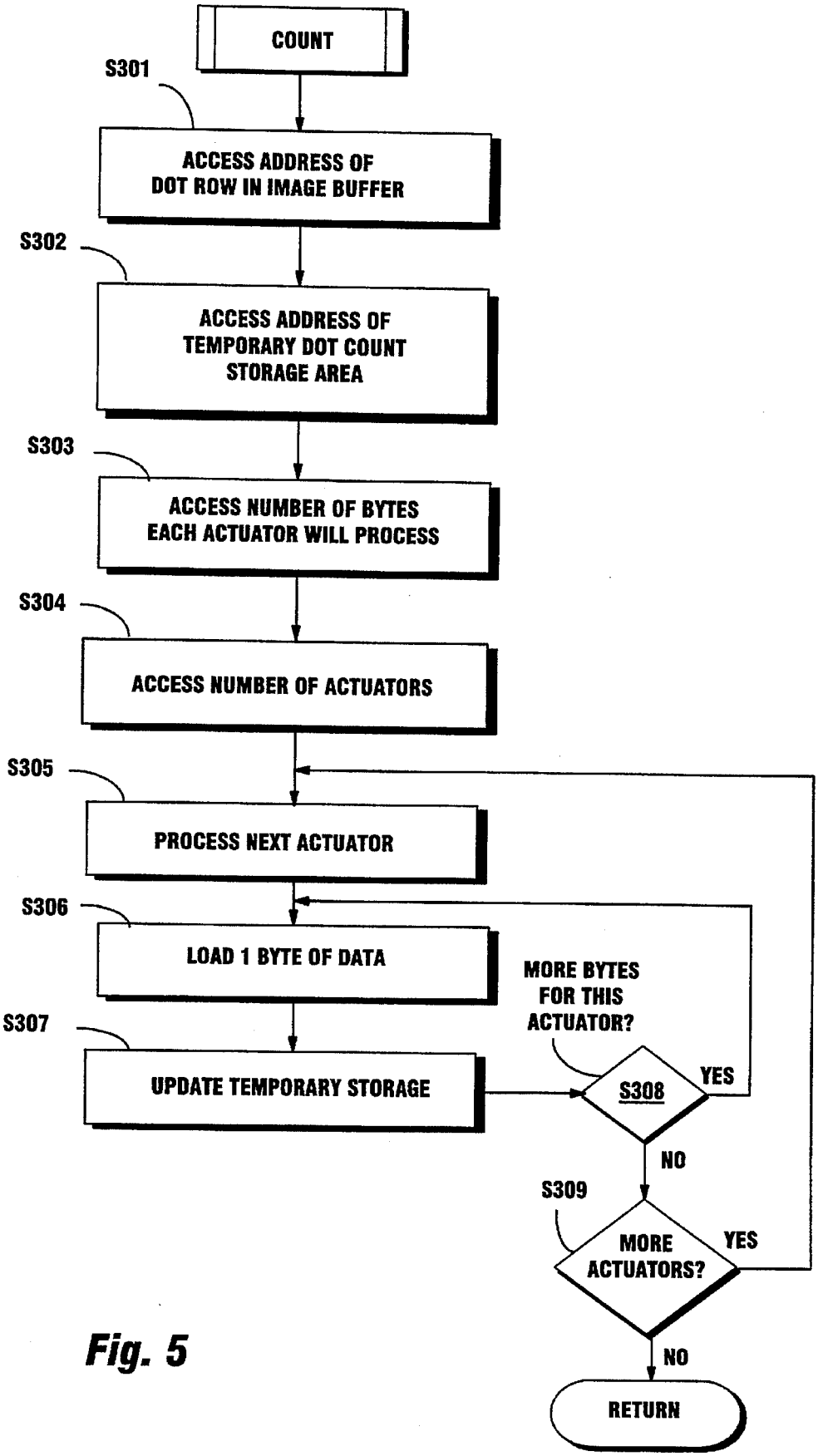
FIG. 5 is a flowchart showing the dot counting process.

FIG. 5 is a flowchart of the dot counting process carried out by the controller during the printing process in step S203. In steps S301 through S304, the controller accesses the information determined during the initialization process and other information stored in the system. In particular, in step S301, the controller accesses the address of the dot rows within the image buffer. In step S302, the controller accesses the address of the temporary dot count storage area. In step S303, the number of bytes of dot data that each actuator can process is accessed. Finally, in step S304, the controller accesses the number of actuators in the printer (e.g., 33 or 66).

As noted above, the counting process is carried out line by line and actuator by actuator. In step S305, a next actuator (or first actuator if this is the first pass) is processed. The controller loads the first byte of data from the dot row and uses the value of the "on" dots as an index into a dot count table (step S306). The value from the dot count table will then be added into the temporary storage location for the first actuator (step S307). In step S308, it is determined whether there are more bytes of dot data to be processed for this actuator. If so (yes in step S308), the controller returns to step S306, and the next byte of dot row data is then processed. In step S309, it is determined whether there are more actuators to process for this row of data. If so (yes in step S309), the controller returns to step S305 to process the next actuator. Each actuator is processed for each row of dot data. When all rows of dot data have been processed, the operation continues as described above with reference to FIG. 4.

Figure 2:
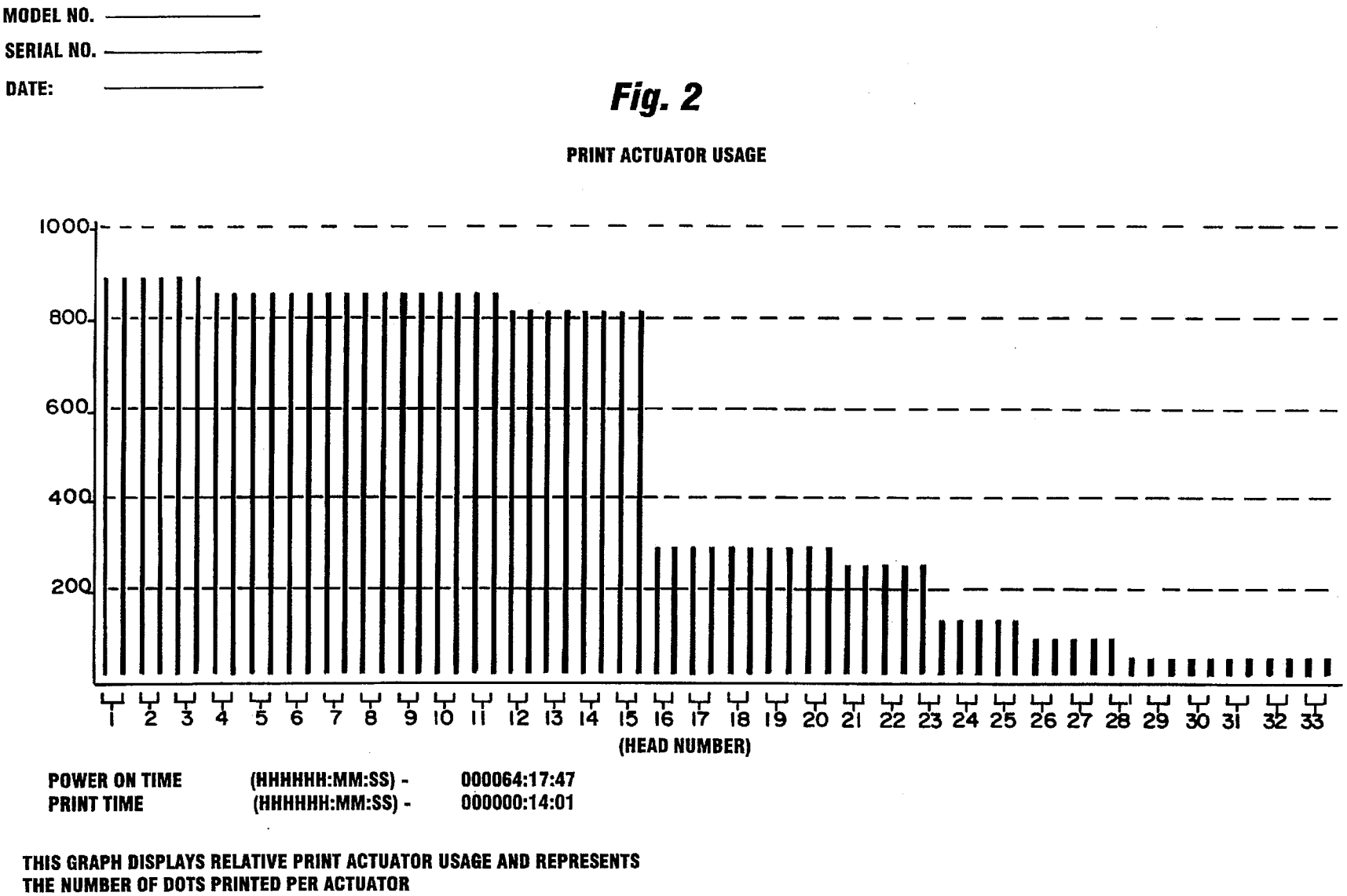
FIG. 2 is an exemplary graph illustrating the print head actuator dot count.

The printer is capable of generating a graphical display to illustrate the number of print actions for each actuator that have been performed relative to the number of print actions in the useful life of the actuator. An example graph is illustrated in FIG. 2. The X axis represents the number of the print head that is displayed. In a 400 line per minute embodiment of the printer, for example, a vertical bar is displayed for each of the 33 print heads. In a 800 line per minute embodiment of the printer, for example, two vertical bars are displayed for each print head since there are two actuators within each head. The Y axis represents the total number of print impact actions performed by each actuator. The values represented will range from 0 to a value determined to be the maximum rated useful life of a print head (e.g., one billion print actions). This chart provides service personnel or user with valuable data to determine when the individual print heads are approaching the end of their useful life to ensure that a constant high degree of print quality will be maintained.

If it is determined that a print actuator should be replaced, the operator can initiate a process to reset the dot count associated with the print actuator that has been replaced.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dot matrix printer comprising:

a plurality of print actuators; and a controller that controls operations of the plurality of print actuators, the controller including a counter, said counter counting a number of print actions performed by each of the plurality of print actuators and a memory, said memory storing the counted number of print actions performed by each print actuator, wherein the controller monitors a useful life of each print actuator based on the counted number of print actions performed by each print actuator stored in the memory.

2. A dot matrix printer according to claim 1, further comprising a plurality of print head modules, each of the plurality of print head modules comprising at least one of said plurality of print actuators.

3. A dot matrix printer according to claim 2, wherein the plurality of print head modules consists of 33 print head modules.

4. A dot matrix printer according to claim 1, wherein the memory function comprises:

a volatile memory that temporarily stores the counted number of print actions performed by each print actuator.

5. A dot matrix printer according to claim 4, wherein the memory further comprises:

a non-volatile memory that stores an accumulated number of print actions performed by each print actuator, the controller periodically adding the counted number of print actions performed by each print actuator stored in the volatile memory to a corresponding accumulated number of print actions performed by each print actuator stored in non-volatile memory.

6. The dot matrix printer according to claim 1, wherein the controller compares the counted number of print actions performed by each print actuator with a reference value to determine a remaining useful life of each print actuator.

7. The dot matrix printer according to claim 1, further comprising:

an indicator connected to the controller for indicating to an operator a useful life remaining for each print actuator based on the counted number of print actions performed by each print actuator.

8. The dot matrix printer according to claim 1, further comprising:

a display connected to the controller for displaying an indication of useful print actuator life for each of the print actuators.

9. The dot matrix printer according to claim 8, wherein the displayed indication is a bar graph which displays for each print actuator a number of print actions performed by each of the actuators as well as remaining useful life of each print actuator.

10. A method of operating a dot matrix printer including a plurality of print actuators and a controller that controls operations of the plurality of print actuators, the method comprising:

counting a number of print actions performed by each of the plurality of print actuators;

storing in a memory the number of print actions performed by each print actuator; and determining a useful life of each print actuator based on the number of print actions stored in the memory for each print actuator.

11. A method according to claim 10, further comprising:

prior to said counting step, initializing the printer including determining a number of bytes of dot data to be processed by each of the plurality of print actuators.

12. A method according to claim 11, further comprising:

verifying a horizontal density of the dot data, wherein if the horizontal density is different than a set horizontal density, re-determining a number of bytes of dot data to be processed by each of the plurality of print actuators.

13. A method according to claim 10, wherein said counting step comprises counting the print actions performed by each print actuator after each row of print data is processed, and updating the number of print actions performed by each print actuator stored in the memory.

14. A method according to claim 13, further comprising:

storing one or more rows of print data in an image buffer, wherein said counting step includes scanning each row of print data stored in the image buffer to determine a number of dots to be printed by each print actuator in printing each row of print data.

15. A method according to claim 14, wherein said updating step comprises updating the number of print actions stored in the memory for each print actuator one print actuator at a time.

16. A method according to claim 10, wherein said storing step comprises temporarily storing the number of print actions in a volatile memory for each print actuator.

17. A method according to claim 16, further comprising:

adding the number of print actions in the volatile memory for each print actuator to accumulated print action values stored in a non-volatile memory for each print actuator.

18. A method according to claim 10, further comprising:

resetting the number of print actions for one of the print actuators whose useful life is determined to have ended when the one print actuator is replaced.

19. A method according to claim 10, further comprising:

outputting a chart representative of the number of print actions performed by each of the plurality of print actuators.

20. The method according to claim 10, wherein the determining step further comprises:

comparing the number of print actions stored in the memory for each print actuator with a reference number of print actions representative of a useful print actuator life.

21. A dot matrix printer including a plurality of print actuators, the dot matrix printer comprising:

counting means for counting a number of print actions performed by each of the plurality of print actuators;

storing means for storing the number of print actions performed by each print actuator; and determining means for determining a useful life of each print actuator based on the number of print actions stored in the memory for each print actuator.

22. A dot matrix printer according to claim 21, wherein said counting means comprises means for counting the print actions performed by each print actuator after each row of print data is processed, and means for updating the number of print actions performed by each print actuator stored in said storing means.

23. A dot matrix primer according to claim 22, further comprising:

an image buffer storing one or more rows of print data, wherein said counting means includes means for scanning each row of print data stored in said image buffer to determine a number of dots to be printed by each print actuator in printing each row of print data.

24. A dot matrix primer according to claim 23, wherein said updating means comprises means for updating the number of print actions stored in said storing means for each print actuator one print actuator at a time.

25. A dot matrix printer according to claim 21, wherein said storing means comprises a volatile memory that temporarily stores the number of print actions for each print actuator.

26. A dot matrix printer according to claim 25, further comprising:

a non-volatile memory and means for adding the number of print actions from the volatile memory for each print actuator to accumulated print action values stored in the non-volatile memory for each print actuator.

27. The dot matrix printer according to claim 21, further comprising:

an indicator for indicating to an operator a remaining useful life for each print actuator based on the counted number of print actions performed by each print actuator.

28. The dot matrix printer according to claim 27, wherein the indicator includes a printed paper output.

29. The dot matrix printer according to claim 27, wherein the indicator includes a display.

30. The dot matrix printer according to claim 27, wherein the indicator includes a bar graph showing print actuator usage and number of dots printed for each print actuator.

31. A method of operating a dot matrix printer including a plurality of print actuators and a controller that controls operation of a plurality of print actuators, comprising the steps of:

providing a display;

counting an accumulated number of print actions performed by each of the plurality of print actuator; and displaying for each of the print actuators the accumulated number of print actions performed by each print actuator on said display.

32. The method in claim 31, wherein the displaying step includes displaying the number of accumulated print actions performed by each print actuator relative to a total number of print actions representative of a useful life of each print actuator.

* * * * *